US011767653B2

(12) United States Patent
Liew et al.

(10) Patent No.: US 11,767,653 B2
(45) Date of Patent: Sep. 26, 2023

(54) GEOSYNTHETIC REINFORCED WALL PANELS COMPRISING SOIL REINFORCING HOOP MEMBERS AND RETAINING WALL SYSTEM FORMED THEREWITH

(71) Applicant: Tensar International Corporation, Alpharetta, GA (US)

(72) Inventors: Willie Liew, Alpharetta, GA (US); Kord J. Wissmann, Alpharetta, GA (US); Andres F. Peralta, Alpharetta, GA (US); Aaron D. Smith, Alpharetta, GA (US)

(73) Assignee: Tensar International Corporation, Alpharetta, GA (US)

( * ) Notice: Subject to any disclaimer, the term of this patent is extended or adjusted under 35 U.S.C. 154(b) by 0 days.

(21) Appl. No.: 17/042,598

(22) PCT Filed: Mar. 28, 2019

(86) PCT No.: PCT/US2019/024607
§ 371 (c)(1),
(2) Date: Sep. 28, 2020

(87) PCT Pub. No.: WO2019/191448
PCT Pub. Date: Oct. 3, 2019

(65) Prior Publication Data

US 2021/0017731 A1 Jan. 21, 2021

Related U.S. Application Data

(60) Provisional application No. 62/649,079, filed on Mar. 28, 2018.

(51) Int. Cl.
*E02D 29/02* (2006.01)

(52) U.S. Cl.
CPC ..... *E02D 29/0266* (2013.01); *E02D 29/0241* (2013.01); *E02D 2200/1642* (2013.01); *E02D 2300/002* (2013.01); *E02D 2600/40* (2013.01)

(58) Field of Classification Search
CPC ..... E02D 29/0266; E02D 29/0241; E02D 2200/1642; E02D 2300/002;
(Continued)

(56) References Cited

U.S. PATENT DOCUMENTS 4,914,887 A * 4/1990 Meheen ..... E02D 29/0241 405/284
5,505,563 A * 4/1996 Curt ..... E02D 5/20 405/262

(Continued)

OTHER PUBLICATIONS

International Search Report and Written Opinion issued in counterpart PCT Application No. PCT/US2019/024607 dated Jun. 14, 2019 (seven (7) pages).

*Primary Examiner* — Carib A Oquendo
(74) *Attorney, Agent, or Firm* — E. Eric Mills; Todd A. Serbin; Maynard Nexsen PC

(57) ABSTRACT

Geosynthetic reinforced wall panels comprising soil reinforcing hoop members and retaining wall system formed therewith is disclosed. Namely, a geosynthetic panel wall system is provided that includes at least one concrete facing panel that has at least one stabilizing hoop coupled thereto and wherein a soil reinforcing element or strip may be coupled to the stabilizing hoop. Additionally, a method of using the presently disclosed geosynthetic panel wall system reinforced with at least one stabilizing hoop and soil reinforcing element is provided.

20 Claims, 18 Drawing Sheets

(58) Field of Classification Search
CPC . E02D 2600/40; E02D 29/0225; E02D 29/02; E02D 2600/30
See application file for complete search history.

(56) References Cited

U.S. PATENT DOCUMENTS

| | | | | |
|---|---|---|---|---|
| 5,540,525 | A | 6/1996 | Miller et al. | |
| 5,568,998 | A | 10/1996 | Egan et al. | |
| 5,586,841 | A * | 12/1996 | Anderson | B29C 49/2408 405/286 |
| 5,800,095 | A | 9/1998 | Egan | |
| 5,934,838 | A | 8/1999 | Egan | |
| 6,287,054 | B1 | 9/2001 | Egan et al. | |
| 9,758,943 | B1 * | 9/2017 | Anderson | B28B 7/10 |
| 2003/0185634 | A1 * | 10/2003 | Babcock | E02D 5/80 405/284 |
| 2003/0213203 | A1 * | 11/2003 | Bott | E02D 29/0241 52/603 |
| 2008/0085162 | A1 * | 4/2008 | Blundell | E02D 29/0266 405/284 |
| 2010/0284751 | A1 * | 11/2010 | Price | E04C 1/395 405/284 |
| 2012/0064262 | A1 * | 3/2012 | Ayers | E02D 29/0241 428/17 |
| 2012/0076592 | A1 * | 3/2012 | Freitag | E02D 29/0241 405/262 |
| 2016/0244936 | A1 * | 8/2016 | MacDonald | B28B 7/0097 |
| 2016/0369472 | A1 * | 12/2016 | Ianello | B28B 7/0044 |
| 2018/0044878 | A1 * | 2/2018 | Lee | E02D 29/0266 |

* cited by examiner

300

400

500

600

700

800

900

| GeoStrip Type | Geogrid Tult (lb/ft) | Geogrid LTDS (lb/ft) | Geogrid Test Width (in) | Peak Connection Strength vs Normal Load (lb/ft) | | | | Displacement vs Normal Load (in) | | | | | | | |
|---|---|---|---|---|---|---|---|---|---|---|---|---|---|---|---|
| | | | | No. 57 Stone Hoop Infill | | GAB Hoop Infill | | No. 57 Stone Hoop Infill | | | | GAB Hoop Infill | | | |
| | | | | | | | | At UX Hoop Tip | | Geogrid Loop from Panel | | At UX Hoop Tip | | Geogrid Loop from Panel | |
| | | | | 200 PSF | 1000 PSF | 200 PSF | 1000 PSF | 200 PSF | 1000 PSF | 200 PSF | 1000 PSF | 200 PSF | 1000 PSF | 200 PSF | 1000 PSF |
| HDPE A | 7810 | 2125 | 12 | 4885 | | 4845 | | 0.5 | | 2 | | 0.75 | | 4 | |
| HDPE B | 9860 | 3683 | 12 | 6291 | 6483 | 5981 | 6596 | 0.75 | 0.25 | 3 | 0.25 | 0.75 | 0.25 | 4 | 1 |
| HDPE C | 11990 | 3262 | 12 | 7035 | 7336 | 7150 | 7300 | 0 | 0 | 0.25 | 0 | 0.75 | 0.25 | 3.5 | 1 |

| Geogrid Type | Geogrid Tult (lb/ft) | Geogrid LTDS (lb/ft) | Geogrid Test Width (in) | Peak Connection Strength vs Normal Load (lb/ft) | | | | Displacement vs Normal Load (in) | | | | | | | |
|---|---|---|---|---|---|---|---|---|---|---|---|---|---|---|---|
| | | | | No. 57 Stone Hoop Infill | | GAB Hoop Infill | | No. 57 Stone Hoop Infill | | | | GAB Hoop Infill | | | |
| | | | | | | | | At UX Hoop Tip | | Geogrid Loop from Panel | | At UX Hoop Tip | | Geogrid Loop from Panel | |
| | | | | 200 PSF | 1000 PSF | 200 PSF | 1000 PSF | 200 PSF | 1000 PSF | 200 PSF | 1000 PSF | 200 PSF | 1000 PSF | 200 PSF | 1000 PSF |
| PET A | 4659 | 2578 | 12 | 2556 | 3286 | 2707 | - | 0.25 | 0 | 0.5 | 0 | 0.25 | - | 0.5 | - |
| PET B | 7263 | 4015 | 12 | 4289 | 4628 | 4190 | 4895 | 0.38 | 0 | 1.5 | 0 | 0.5 | 0 | 1.5 | 0 |
| PET C | 9318 | 5151 | 12 | 6180 | 7127 | 5275 | 5823 | 0 | 0 | 0.25 | 0 | 0.63 | 0.25 | 2.5 | 0.25 |
| PET D | 14046 | 7765 | 12 | 6980 | 8576 | 6156 | 8350 | 0.75 | 0.25 | 3 | 0.5 | 0.75 | 0.25 | 3 | 0.5 |

FIG. 16

GEOSYNTHETIC REINFORCED WALL PANELS COMPRISING SOIL REINFORCING HOOP MEMBERS AND RETAINING WALL SYSTEM FORMED THEREWITH

CROSS REFERENCE TO RELATED APPLICATIONS

The presently disclosed subject matter is a 35 U.S.C. § 371 U.S. national phase entry of International Application No. PCT/US2019/024607 having an international filing date of Mar. 28, 2019, which is related to and claims priority to U.S. Provisional Patent App. No. 62/649,079, entitled "Geosynthetic Reinforced Wall Panels Comprising Soil Reinforcing Hoop Members and Retaining Wall System Formed Therewith," filed on Mar. 28, 2018; the entire disclosures of which are incorporated herein by reference.

TECHNICAL FIELD

The presently disclosed subject matter relates generally to the retention of earthen formations and the field of retaining walls and more particularly to a geosynthetic reinforced wall panels comprising soil reinforcing hoop members and retaining wall system formed therewith.

BACKGROUND

Retaining walls are commonly used for architectural and site development applications. Retaining walls have historically been constructed from mass concrete. More recently, retaining walls are often constructed using systems of modular facades connected to soil reinforcing elements. Such soil reinforced earthen works are often called "Mechanically Stabilized Earth" structures and have now become a recognized civil engineering structure useful in the retention of hillsides, right of way embankments, and the like. The wall facing elements, which typically consist of masonry blocks, concrete blocks, concrete panels, and/or welded wire forms, are designed to withstand lateral pressures exerted by backfill soils. Reinforcement and stabilization of the soil backfill in mechanically stabilized earth applications is commonly provided using metallic or geosynthetic materials, such as geogrids or geotextiles, that are placed horizontally in the soil fill behind the wall face. The reinforcing elements are connected to the wall face elements and interact with the soil to create a stable reinforced soil mass.

Wall facing elements most often consist of concrete masonry blocks and/or concrete panels. The use of both full height as well as segmental variable height pre-cast concrete wall panels for wall-facing elements in a retaining wall is known such as is disclosed in U.S. Pat. No. 5,568,998, entitled "Precast wall panel and grid connection device" and U.S. Pat. No. 5,580,191, entitled "Marine wall."

Metallic reinforcing elements comprised of steel and the like have the benefit of exhibiting a high tensile strength and are relatively easy to connect to the wall facing units. Because of their inherently high tensile strength, steel reinforcements often are comprised of discrete strips that are individually bolted to the facing panels. However, a drawback of metallic elements is that they are corrodible and are thus not optimal in backfill materials that are aggressive to metals.

Geosynthetic reinforcing elements, typically comprised of polyethylene terephthalate (PET) or high-density polyethylene (HDPE), are also used for current mechanically stabilized earth retaining structures. Polyester materials, which are high in allowable tensile strength, are not easily connected to wall facing panels and typically require a gravity "pinch" connection to the wall facing element. However, PET reinforcing elements that are mechanically connected to the wall facing panels are typically inefficient due to low connection strength or requiring weaving or wrapping of the PET reinforcing element through an expensive high strength mechanical connector connected to the wall facing panels.

HDPE materials typically have high junction strength to form a robust connection to wall facing panels. However, HDPE is subject to creep deformations whereby this limitation results in a lower allowable tensile strength. Further, the connections between the panel face and reinforcement must be made along the entire panel width. This connection is not simple to employ in the field and results in connection "slack" that exists because the connections may be difficult to seat prior to loading the wall with the backfill soil. The combination of the applied soil pressure and the connection slack results in panel walls that may displace laterally during construction, sometimes resulting in un-plumb and unsightly facades. Accordingly, new approaches are needed with respect to methods and/or techniques of reinforcing retaining walls. For example, improvements are needed with respect to increasing the efficiency in the connection system strength and thereby improving the stability of the retaining wall and the retained soil mass.

SUMMARY

The presently disclosed subject matter is summarized as a geosynthetic panel wall system including one or more each of a concrete facing panel element, a stabilizing hoop element coupled to one side of the concrete facing panel element, and a soil reinforcing element coupled to the stabilizing hoop element.

In one example, the concrete facing panel is multiple concrete facing panels, and the stabilizing hoop is multiple stabilizing hoops. The multiple concrete facing panels may be arranged end-to-end, and each of the multiple concrete facing panels may be coupled to the multiple stabilizing hoops.

In another example, the plurality of stabilizing hoops may be arranged vertically on the concrete facing panel. The plurality of stabilizing hoops can also be arranged side-by-side on the concrete facing panel.

In still another example, the stabilizing hoop may be semi-circular in shape having a height H, a length L, and a depth D. The stabilizing hoop may be filled with soil fill.

The soil reinforcing element may be a strip having a width. In one example, the strip may be a continuous wrap from the bottom of the stabilizing hoop to the top of the stabilizing hoop and adapted to be splayed. The strip is made of PET, HDPE, or other flexible material. In another example, the strip may be a geogrid made of geotextiles.

The geosynthetic panel wall system may be free standing. In one such example, the concrete facing panel may be coupled atop a leveling pad to form a free standing gravity geosynthetic panel wall system.

The present subject matter may also include a method of reinforcing a wall. One example of such method may include the steps of: providing a geosynthetic panel wall system having one or more each of a concrete facing panel, a stabilizing hoop, and a soil reinforcing element; casting one or more of the stabilizing hoops onto one or more of the concrete facing panels, wherein each concrete facing panel is coupled to at least one stabilizing hoop on one side of the concrete facing panel; forming a leveling pad; propping the concrete facing panel atop the leveling pad; placing and compacting soil backfill against the one side of the concrete facing panel up to the bottom of the coupled stabilizing hoop; cutting the soil reinforcing element into a strip; placing the strip through the stabilizing hoop against and over the concrete facing panel; filling the stabilizing hoop with soil fill; placing and compacting backfill up to the top of the stabilizing hoop; and folding down the strip into the backfill.

BRIEF DESCRIPTION OF THE DRAWINGS

Figure 1:
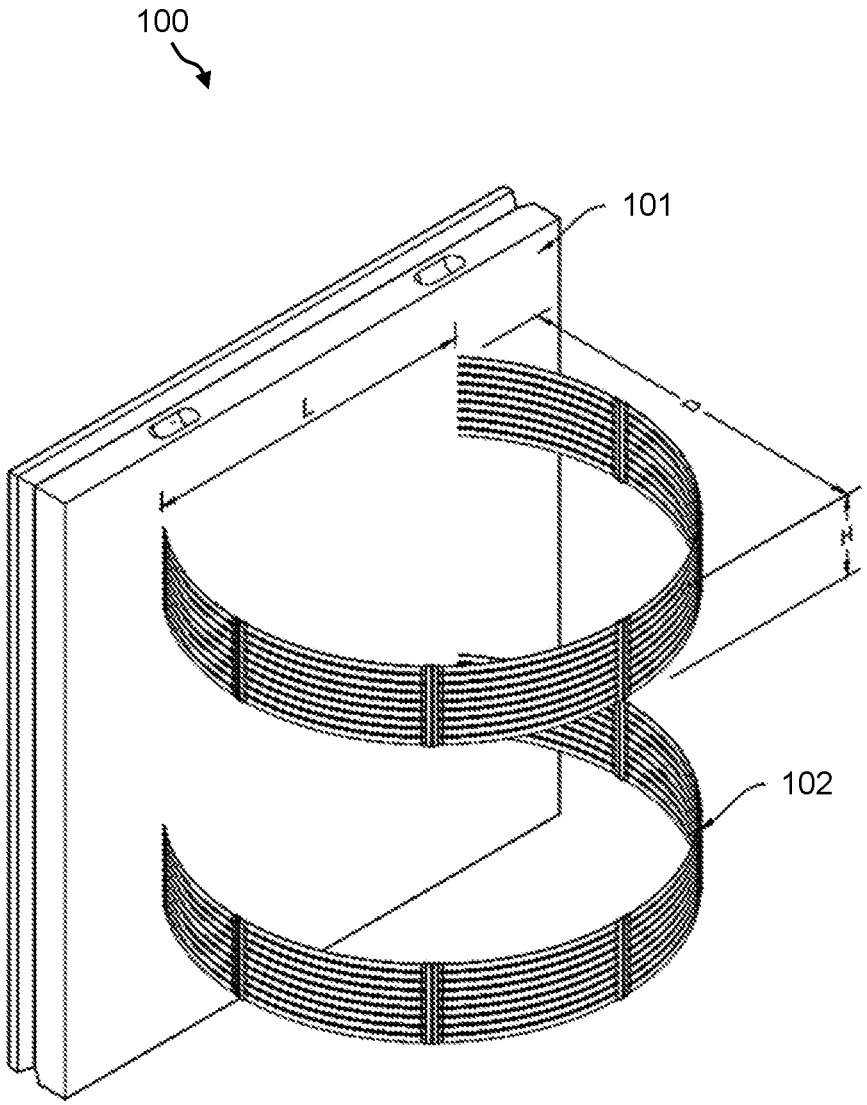
Figure 2A:
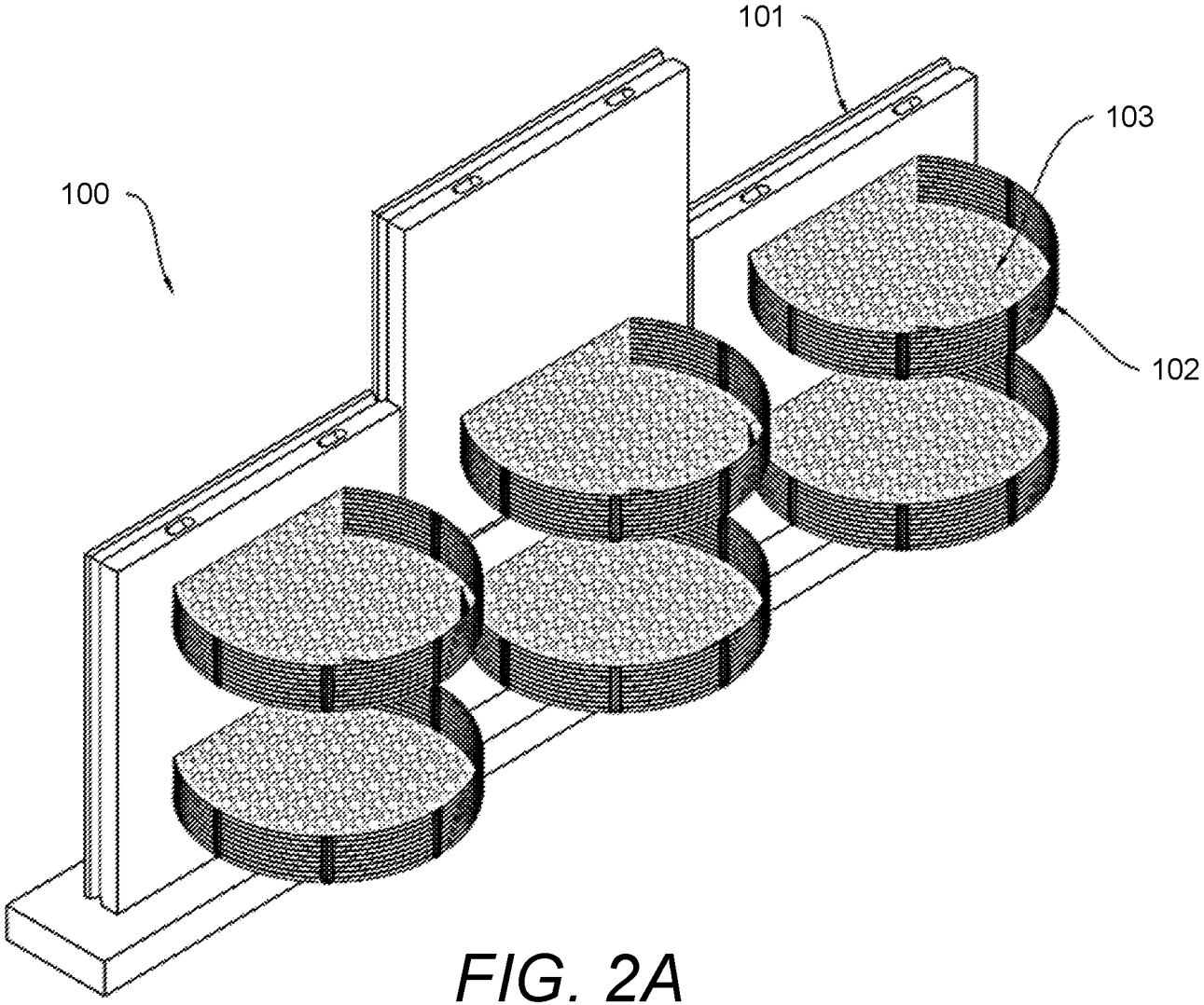
Figure 2B:
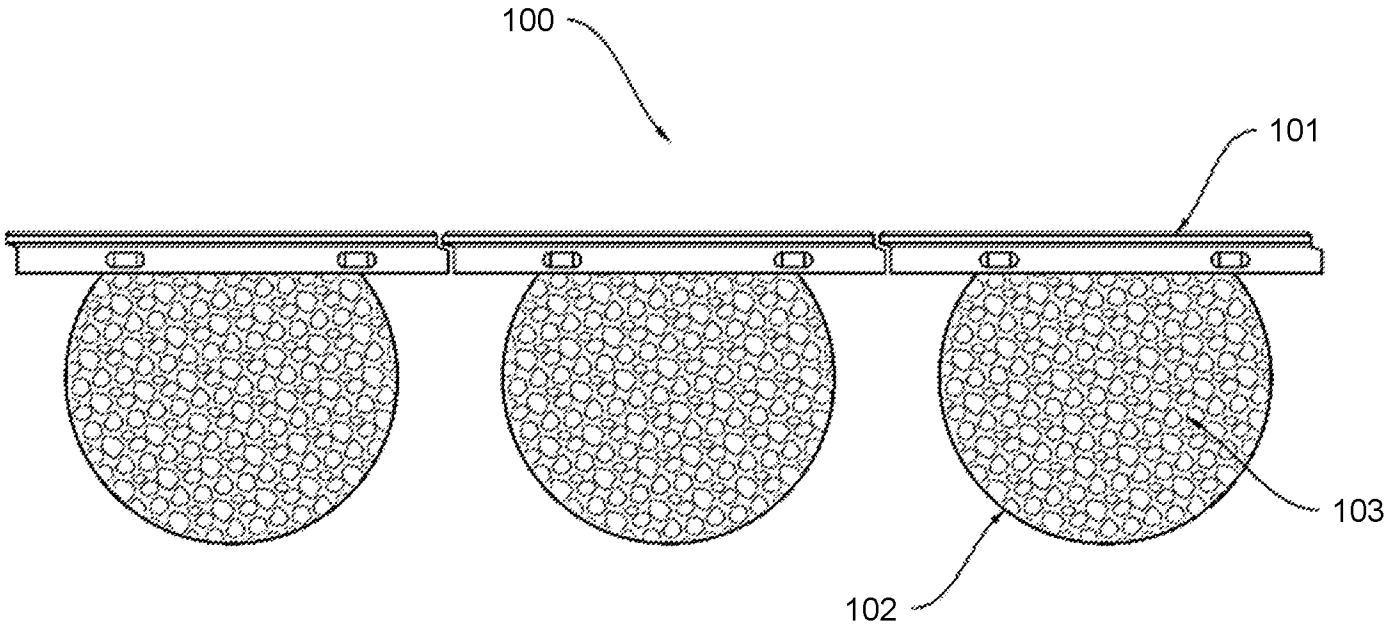
Figure 3:
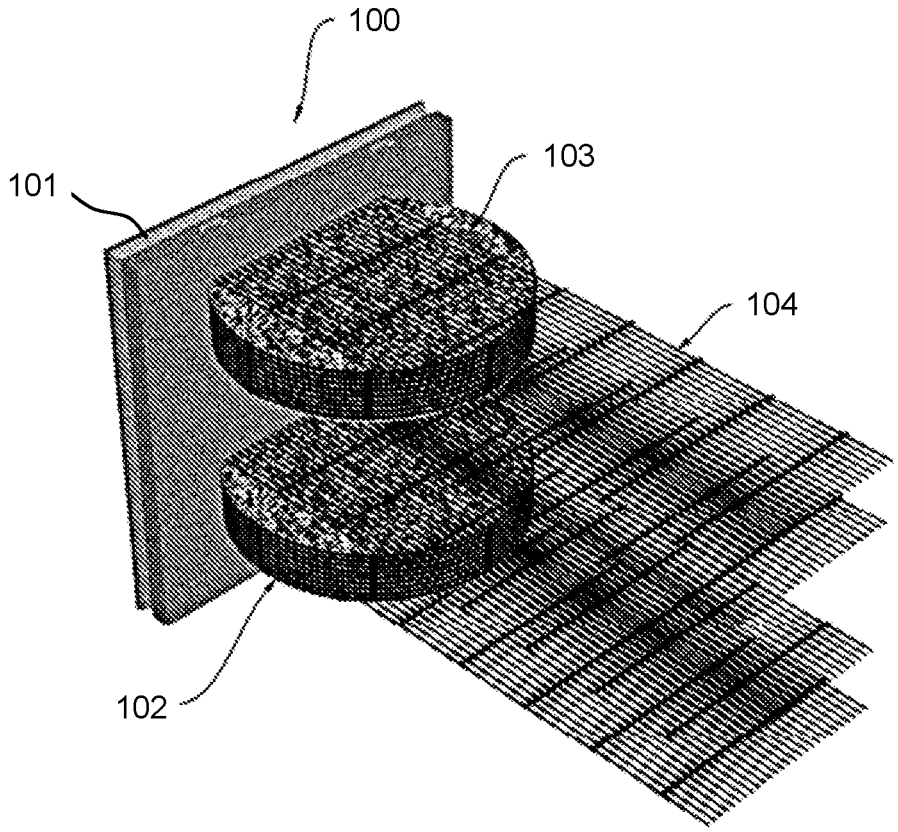
Figure 4:
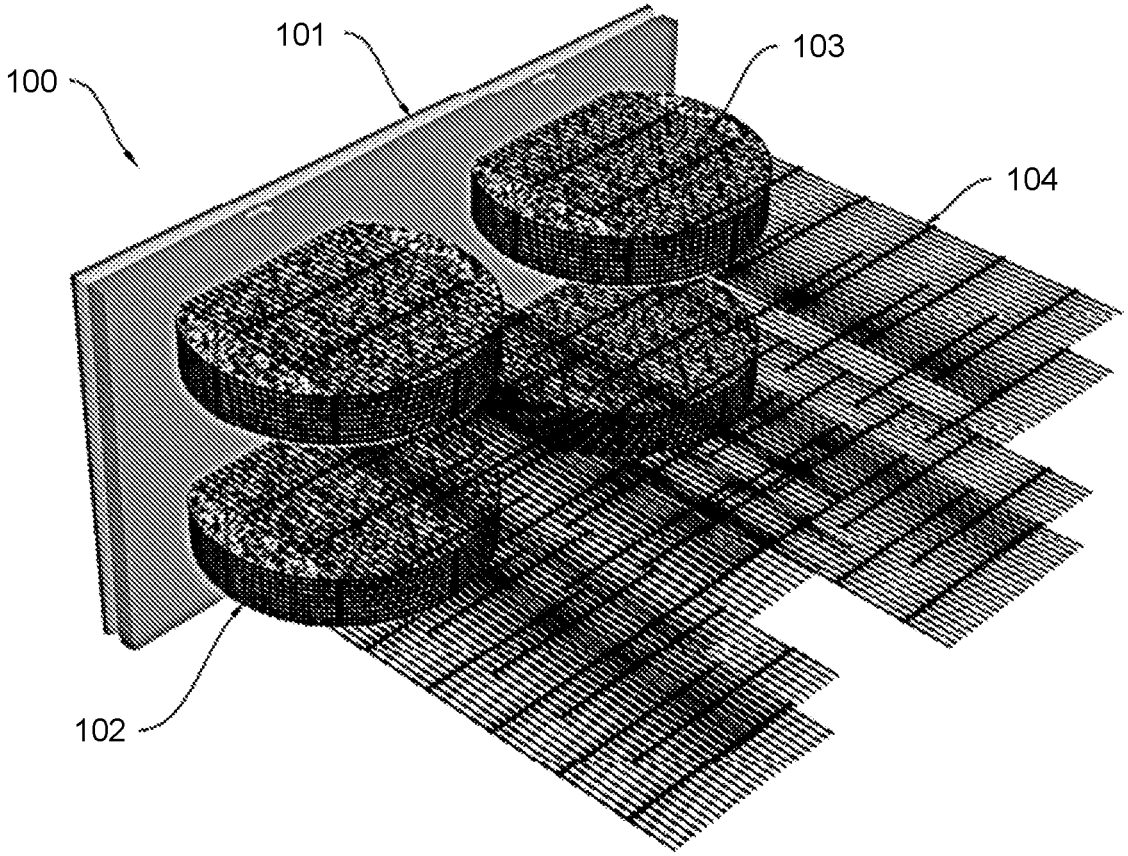
Figure 5:
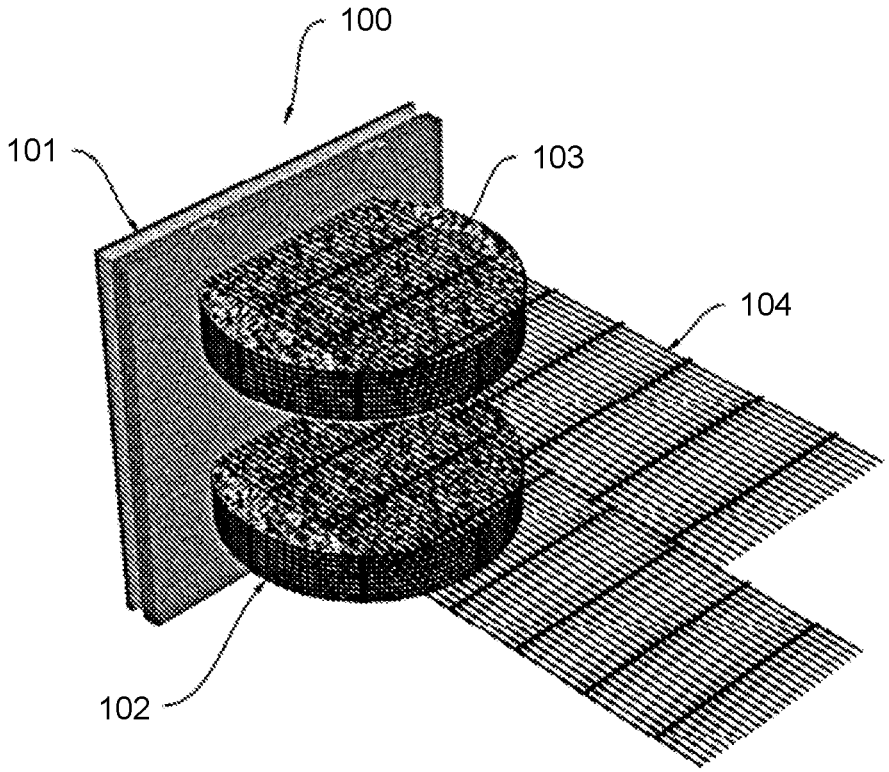
Figure 6:
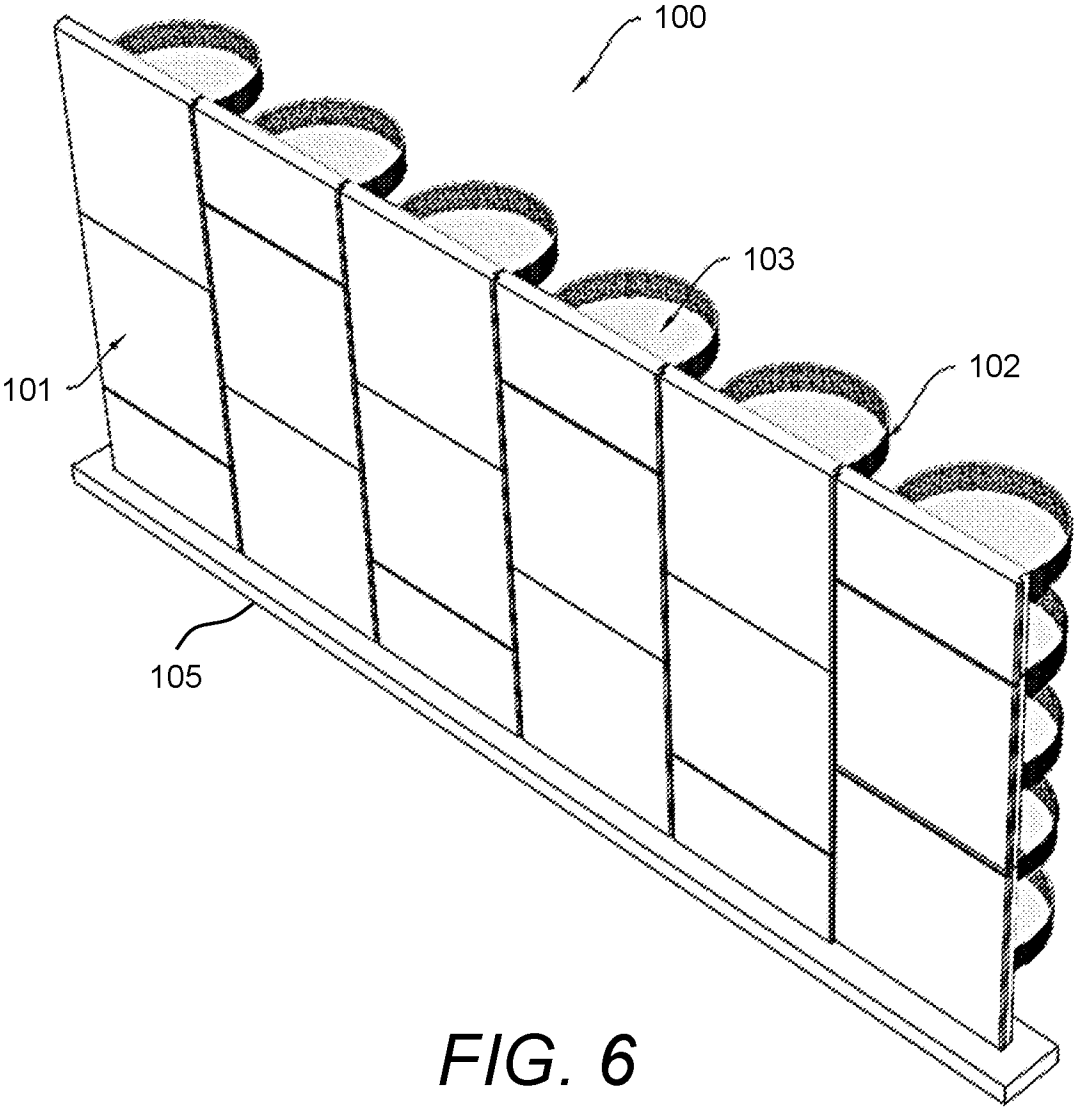
Figure 7:
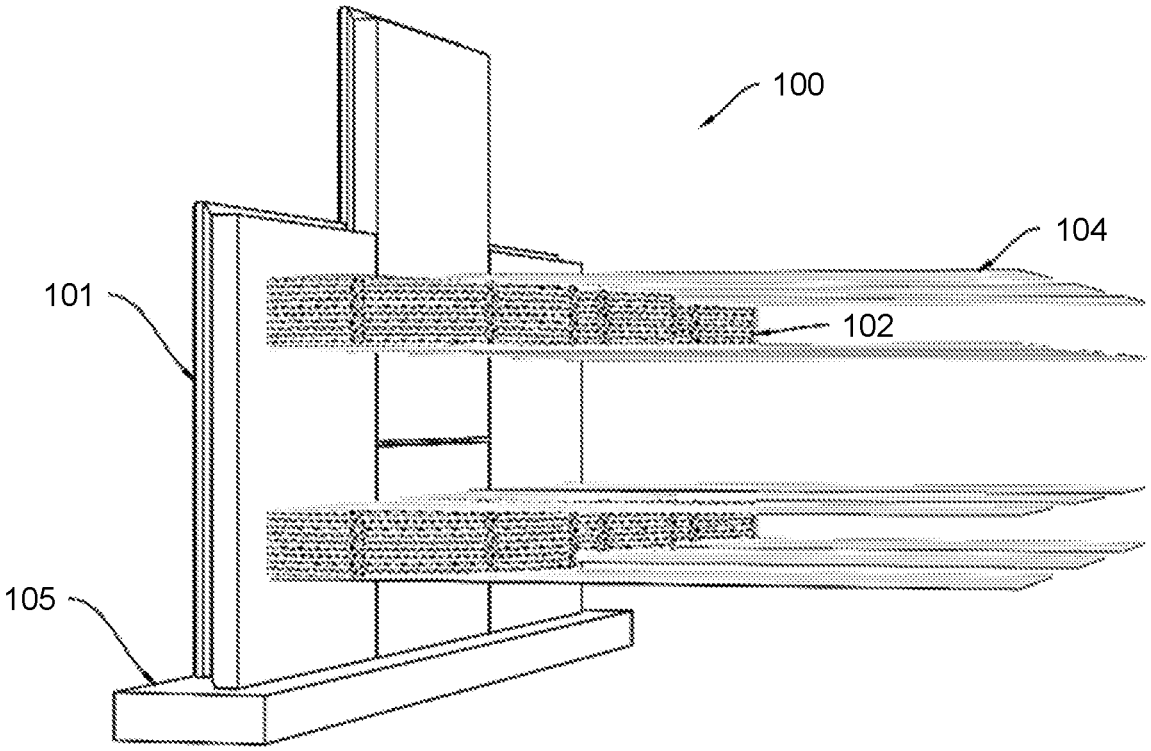
Figure 8A:
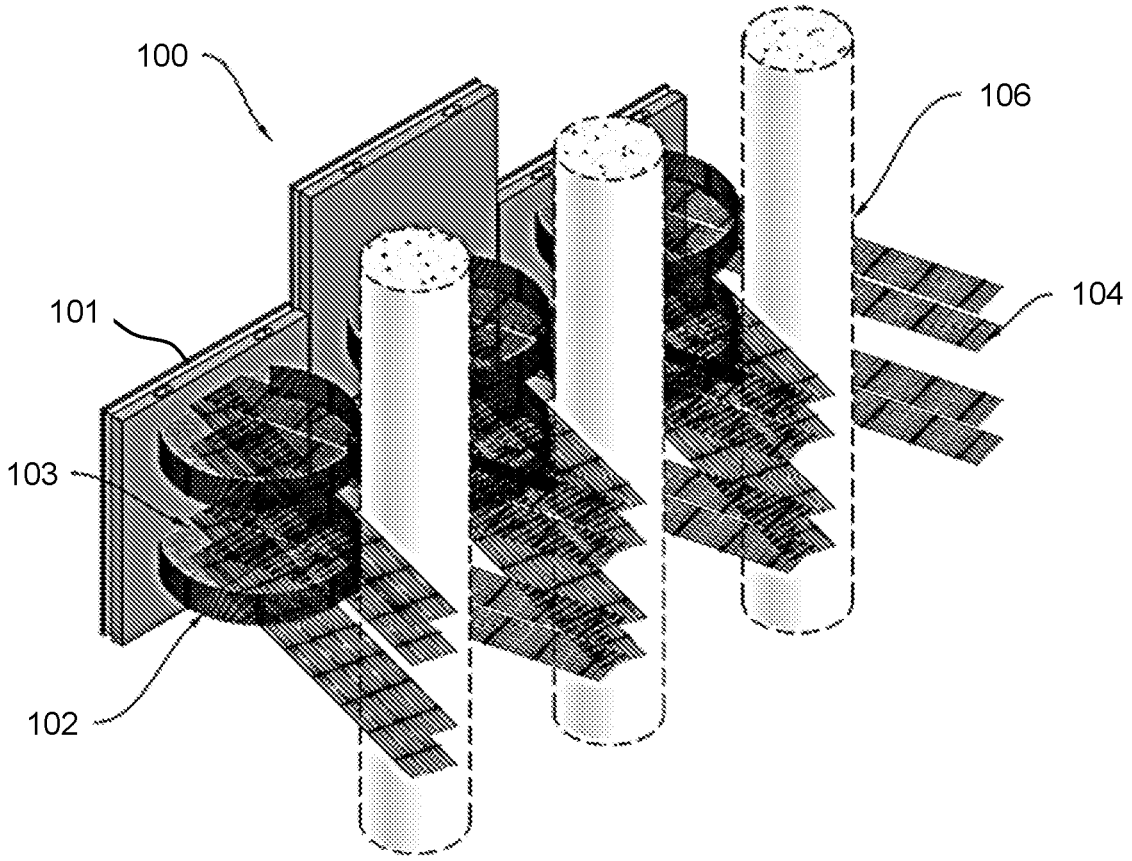
Figure 8B:
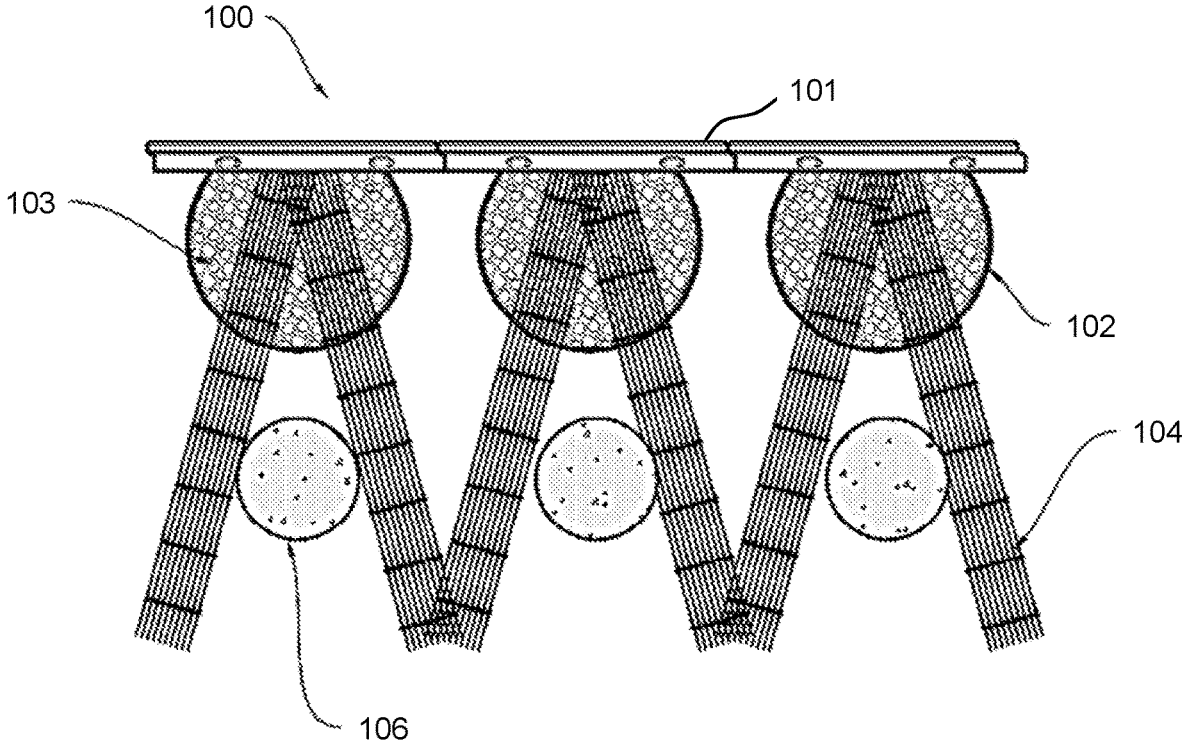
Figure 9:
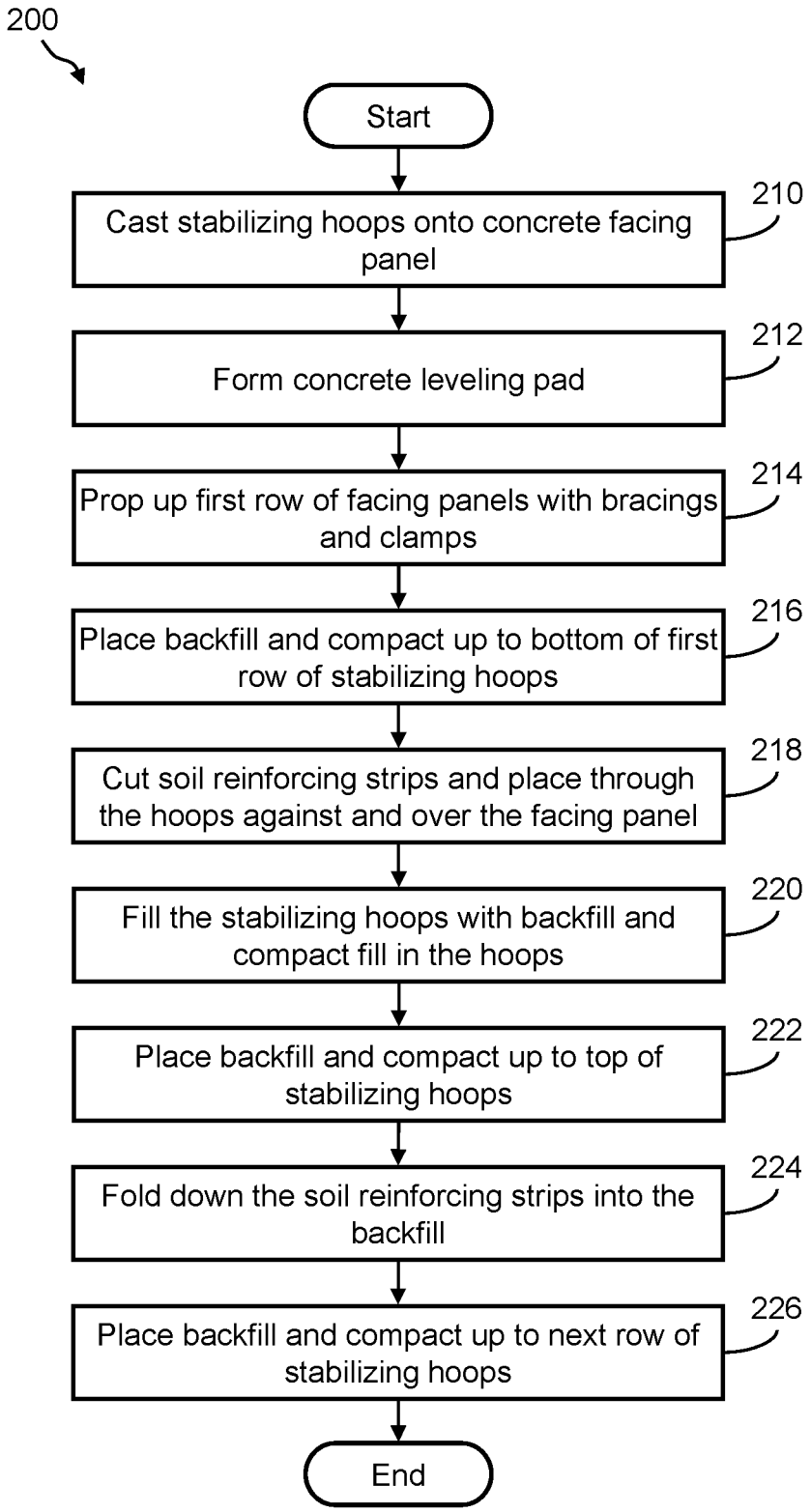

Having thus described the presently disclosed subject matter in general terms, reference will now be made to the accompanying drawings, which are not necessarily drawn to scale, and wherein:

FIG. 1 illustrates a perspective view of an example of the presently disclosed geosynthetic panel wall system that includes stabilizing hoops, wherein the stabilizing hoops can be used to stabilize a concrete facing panel and connected to any other soil reinforcing element;

FIG. 2A and FIG. 2B illustrate a perspective view and a top view, respectively, of an example of the stabilizing hoops of the presently geosynthetic panel wall system filled with soil and/or gravel;

FIG. 3 illustrates a perspective view of the presently disclosed geosynthetic panel wall system that includes stabilizing hoops connected to soil reinforcing elements in strip form;

FIG. 4 illustrates a perspective view of presently disclosed geosynthetic panel wall system that includes stabilizing hoops connected to soil reinforcing elements on a wide concrete panel facing;

FIG. 5 illustrates a perspective view of an example of a connection variation of the presently disclosed geosynthetic panel wall system;

FIG. 6 illustrates a front perspective view of an example of a free-standing gravity geosynthetic panel wall system that includes stabilizing hoops;

FIG. 7 illustrates a rear perspective view of the geosynthetic panel wall system that includes stabilizing hoops connected to soil reinforcing elements;

FIG. 8A and FIG. 8B illustrate a perspective view and a top view, respectively, of an example of the presently disclosed geosynthetic panel system that includes stabilizing hoops connected to soil reinforcing elements that are arranged to avoid vertical obstructions;

FIG. 9 illustrates a flow diagram of an example of a method of using the presently disclosed geosynthetic panel wall system reinforced with stabilizing hoops and soil reinforcing elements;

FIG. 10 through FIG. 15 show plots of horizontal wall profiles indicating an example of field tests conducted to demonstrate panel stability using stabilizing hoops of the presently disclosed subject matter; and FIG. 16 shows a table indicating an example of test results with respect to connection strength, displacement, and failure mode of stabilizing hoops and soil reinforcing elements of the presently disclosed subject matter.

DETAILED DESCRIPTION

The presently disclosed subject matter now will be described more fully hereinafter with reference to the accompanying drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated drawings. Therefore, it is to be understood that the presently disclosed subject matter is not to be limited to the specific embodiments disclosed and that modifications and other embodiments are intended to be included within the scope of the appended claims.

In some embodiments, the presently disclosed subject matter provides a geosynthetic reinforced wall panel comprising soil reinforcing hoop members and retaining wall system formed therewith. Namely, a geosynthetic panel wall system is provided that includes at least one concrete facing panel that has at least one stabilizing hoop coupled thereto and wherein a soil reinforcing element or strip may be coupled to the stabilizing hoop.

In some embodiments, the presently disclosed subject matter provides a stabilized concrete facing panel, a connection system, a soil reinforcing system, and methods related thereto. For example, the stabilized concrete facing panel with stabilizing hoops can be used for constructing retaining walls. The stabilized concrete panel can be fabricated through a wet-cast process. The stabilized concrete panel using stabilizing hoops provides increased panel stability during construction as compared with convention methods.

In some embodiments, the presently disclosed geosynthetic panel wall system that includes stabilizing hoops provides a simple connection system with few components for ease of installation, improved connection performance, and improved facing panel alignment.

In some embodiments, the presently disclosed geosynthetic panel wall system that includes stabilizing hoops provides discrete soil reinforcing elements, such as PET strips, HDPE strips, and/or other flexible soil reinforcing elements, that can all use a common connection method. The discrete soil reinforcing elements (e.g., geogrid strips) are wrapped through the stabilizing hoop, which allows the splaying of the soil reinforcing elements to avoid vertical obstructions, and therefore provide quick installation and a means to mitigate challenges around vertical obstructions.

Accordingly, the presently disclosed geosynthetic panel wall system includes stabilizing hoops for panel stability during construction and provides a high strength reinforcing element that is not subject to corrosion. Further, the geosynthetic panel wall system has a simple and effective connection system that does not rely on the type of reinforcement.

Referring now to FIG. 1 is a perspective view of an example of the presently disclosed geosynthetic panel wall system 100 that includes one or more stabilizing hoops 102, wherein the stabilizing hoops 102 can be used to stabilize a concrete facing panel and can be connected to any other soil reinforcing element. In the panel wall system 100, the stabilizing hoops 102 are mechanically coupled to one side (i.e., the back side) of a concrete facing panel 101. In one example, a plurality of stabilizing hoops are arranged vertically, one above the other, on the concrete facing panel. The panel wall system 100 that includes the concrete facing panel 101 and the stabilizing hoops 102 can be used to form free-standing gravity walls, retaining walls, and/or any other soil reinforcing structure.

Each of the stabilizing hoops 102 has a height H, a length L and a depth D, and can be made of wide range of materials, including but not limited to, polymer, steel or composite materials, and in the preferred embodiment, HDPE material. The stabilizing hoop 102 can be shaped in various forms. In one example, the stabilizing hoop 102 has a circular shape. The height H of the stabilizing hoop 102 can be from about 6 inches (15.24 cm) to about 30 inches (76.2 cm) in one example, or is about 8 inches (20.32 cm) in another example. The length L and the depth D of the stabilizing hoop 102 can from about 24 inches (60.96 cm) to about 96 inches (243.84 cm) in one example, or is about 36 inches (91.44 cm) in another example.

While the geosynthetic panel wall system 100 shown in FIG. 1 includes one concrete facing panel 101, this is exemplary only. The presently disclosed geosynthetic panel wall system 100 can include any arrangement and/or number of concrete facing panels 101 and their corresponding stabilizing hoops 102, as shown for example hereinbelow with reference to FIG. 2A through FIG. 8B. Additionally, the width and/or height of the concrete facing panel 101 can vary to accommodate any number of stabilizing hoops arranged vertically and/or horizontally.

Referring now to FIG. 2A and FIG. 2B is a perspective view and a top view, respectively, of an example of the stabilizing hoops 102 of the presently geosynthetic panel wall system 100 filled with soil and/or gravel. In this example, the panel wall system 100 includes multiple concrete facing panels 101 arranged end-to-end and each having their corresponding stabilizing hoops 102. In this example, the stabilizing hoops 102 of each concrete facing panel 101 are filled with soil fill 103. The confined soil fill 103 in the stabilizing hoop 102 increases the effective depth of the concrete facing panel 101 and stabilizes the concrete facing panel 101 against overturning moment or force and control facing panel movement even in the absence of any other soil reinforcing elements.

Referring now to FIG. 3 is a perspective view of the presently disclosed geosynthetic panel wall system 100 that includes the stabilizing hoops 102 connected to soil reinforcing elements 104 and wherein the soil reinforcing elements 104 are in strip form. In this example, the stabilizing hoops 102 are backfilled with the soil fill 103. The confined soil fill 103 in the stabilizing hoops 102 provides stability to the concrete facing panel 101 while the soil reinforcing elements 104 provide tensile resistance to stabilize the wall backfill (not shown). The soil reinforcing elements 104 may be, for example, discrete strips of a synthetic material, such as strips of HDPE and/or PET, or other flexible reinforcing elements. The soil reinforcing elements 104 are installed with a substantially continuous wrap from the bottom of the stabilizing hoop 102 to the top of the stabilizing hoop 102. The wrapping of the soil reinforcing elements 104 against the stabilizing hoop 102 that is filled with soil fill 103 forms the mechanical connection of the panel wall system 100. The soil reinforcing element 104 can be a narrow strip of reinforcement that is from about 6 inches (15.24 cm) to 48 inches (121.92 cm) wide in one example, or is about 24 inches (60.96 cm) wide in another example.

Referring now to FIG. 4 is a perspective view of presently disclosed geosynthetic panel wall system 100 that includes stabilizing hoops 102 connected to soil reinforcing elements 104 and wherein the concrete facing panel 101 is suitably wide to support at least two stabilizing hoops 102 arranged side-by-side. For example, one or more columns of stabilizing hoops 102 is added to the wide concrete facing panel 101 to provide panel facing stability. Similarly, the stabilizing hoops 102 are filled with soil fill 103 and backfilled with soil fill (not shown) while the soil reinforcing elements 104 are installed to provide tensile resistance to stabilize the wall backfill (not shown).

Referring now to FIG. 5 is a perspective view of an example of a connection variation of the presently disclosed geosynthetic panel wall system 100. In this example, the geosynthetic panel wall system 100 that includes stabilizing hoops 102 allows for gravity or frictional connection between the confined soil fill 103 in the stabilizing hoop 102 and soil reinforcing element 104. The stabilizing hoop 102 with confined soil fill 103 alone provides sufficient anchorage and stability to the individual concrete facing panel 101 and substantially eliminates the need for the concrete facing panel 101 to be mechanically or positively connected to the soil reinforcing element 104.

Referring now to FIG. 6 is a front perspective view of an example of a free-standing gravity geosynthetic panel wall system 100 that includes a series of concrete facing panels 101 and wherein the stabilizing hoops 102 are filled with soil fill 103. In this example, the series of the concrete facing panels 101 is installed atop a leveling pad, such as a concrete leveling pad 105. The soil weight of the confined soil fill 103 in the stabilizing hoops 102 increases the effective depth of the retaining wall to provide sufficient vertical overburden weight to resist the lateral pressure from the backfill soil (not shown) behind the stabilizing hoops 102.

FIG. 7 illustrates a rear perspective view of the geosynthetic panel wall system 100 that includes a series of the concrete facing panels 101 and stabilizing hoops 102. Again, the concrete facing panels 101 may be installed atop a leveling pad, such as the concrete leveling pad 105. In this example, the stabilizing hoops 102 may be cast into each concrete facing panel 101 prior to panel placement on the leveling pad 105. The panel wall system 100 includes the soil reinforcing elements 104 that are wrapped continuously through the corresponding stabilizing hoops 102 against the concrete facing panel 101 and back into the backfill (not shown). In one example, the soil reinforcing elements 104 may be "geogrid" structures in strip form.

A "geogrid" is a grid structure whose primary purpose is to strengthen or reinforce soil and has open meshes into which soil particles can lock. A preferred form of geosynthetic reinforcement is made by the process disclosed in U.S. Pat. No. 4,374,798 ("the '798 patent") using HDPE. The reinforcements are known as "integral geogrids". Integral geogrid material may be uniaxially oriented according to the '798 patent to provide grid-like sheets including a plurality of elongated, parallel, molecularly oriented strands with transversely extending bars integrally connected thereto by less oriented or unoriented junctions, the strands, bars and junctions together defining a multiplicity of elongated openings. HDPE materials are not susceptible to chemical attack and the high junction strength of the processed materials results in robust connections. Accordingly, this type of geogrid is an example of the soil reinforcing elements 104 of the panel wall system 100 and wherein the geogrid is provided in strip form.

Referring now to FIG. 8A and FIG. 8B is a perspective view and a top view, respectively, of an example of the soil reinforcing elements 104 of the presently disclosed geosynthetic panel wall system 100 arranged to avoid vertical obstructions 106. In the panel wall system 100, the connection system of wrapping the soil reinforcing elements 104 in strip form through the stabilizing hoops 102 in confined soil fill 103 allows splaying of the soil reinforcing elements 104 to avoid vertical obstructions 106. This capability of the geosynthetic panel wall system 100 reduces the need for special connectors, tools, and/or designs to splay the soil reinforcing elements 104.

Referring now to FIG. 9 is a flow diagram of an example of a method 200 of forming and using the presently disclosed geosynthetic panel wall system 100 that is reinforced with the stabilizing hoops 102 and the soil reinforcing elements 104. Namely, the method 200 references a simple configuration of one or more concrete facing panels 101 and the stabilizing hoops 102 and the soil reinforcing elements 104. The method 200 may include, but is not limited to, the following steps.

At a step 210, at a precast concrete facility, one or more concrete facing panels 101 are provided wherein at least one stabilizing hoop 102 is cast onto each panel.

At a step 212, a level pad, such as the leveling pad 105 shown in FIG. 6 and FIG. 7, is constructed with concrete to ensure a level surface or foundation on which the concrete facing panel 101 can be installed and erected.

At a step 214, the first row of the concrete facing panels 101 to be propped up is braced at the front and clamped on the sides.

At a step 216, the soil backfill is placed and compacted against the concrete facing panels 101 up to the bottom of the first row of the stabilizing hoops 102.

At a step 218, the soil reinforcing elements 104 are cut and then each placed through its respective stabilizing hoop 102 in a manner that is against and over its concrete facing panel 101. For example, strips of geogrid are cut and then each placed through its respective stabilizing hoop 102 in a manner that is against and over its concrete facing panel 101. The soil reinforcing elements 104 should have sufficient length to form a continuous wrap and then back into the backfill zone.

At a step 220, each of the stabilizing hoops 102 is filled with soil (e.g., soil fill 103) and compacted to engage the stabilizing hoops 102 to the concrete facing panel 101.

At a step 222, backfill is placed on top of the soil reinforcing elements 104 (e.g., strips of geogrid) and also surrounding the confined soil fill 103 to the top of the stabilizing hoop 102. Then, the backfill is compacted.

At a step 224, the soil reinforcing elements 104 (e.g., strips of geogrid) are folded down and pulled back into the backfill zone. The soil reinforcing elements 104 are tensioned by hand and held down with small piles of backfill.

At a step 226, more soil backfill is placed and compacted against the concrete facing panels 101 up to the bottom of the next row of the stabilizing hoops 102.

EXAMPLES

Example 1

Full-scale field tests were conducted to demonstrate the panel stability using stabilizing hoops 102 with stone and sand infill, and various connection concepts using soil reinforcing strips (i.e., soil reinforcing elements 104). Two separate test walls (Wall A and Wall B) were installed in back-to-back configuration with 3 columns of 5 feet (1.52 m) tall×5 feet (1.52 m) wide precast concrete panels on each side. Each column is identified by the wall name and a number to represent column number such as Column A-1, A-2 and A-3 for Wall A and Column B-1, B-2 and B-3 for Wall B. The total wall height was 15 feet (4.57 m). The stabilizing hoops 102 were 8 inches (20.32 cm) high, 4 feet (1.22 m) wide across the panel, and 3 feet (0.91 m) deep into the backfill. The backfill was placed and compacted in 10 inches (25.4 cm) lift maximum with typical equipment 15,000 lbs single-drum vibratory roller. The backfill within 3 feet (0.91 m) of concrete facing panel was compacted with hand-held plate tamper simulating construction technique for mechanically stabilized earth wall. The following combination of HDPE and PET soil reinforcing strips, connection and hoop infill were tested at the test walls:

1) HDPE and PET soil reinforcing strip loop through the hoop with stone infill.
2) HDPE and PET soil reinforcing strip loop through the hoop with sand infill.
3) HDPE and PET soil reinforcing strip overlapping hoop on stone infill.
4) HDPE and PET soil reinforcing strip overlapping hoop with sand infill.

Horizontal wall profile data of the completed test walls was collected using a laser distance measuring tool during construction, right after construction, 40 days, 84 days, 140 days, and 272 days after construction. The test walls were subjected to over 70 inches (1.78 m) of precipitation after construction.

Figure 10:
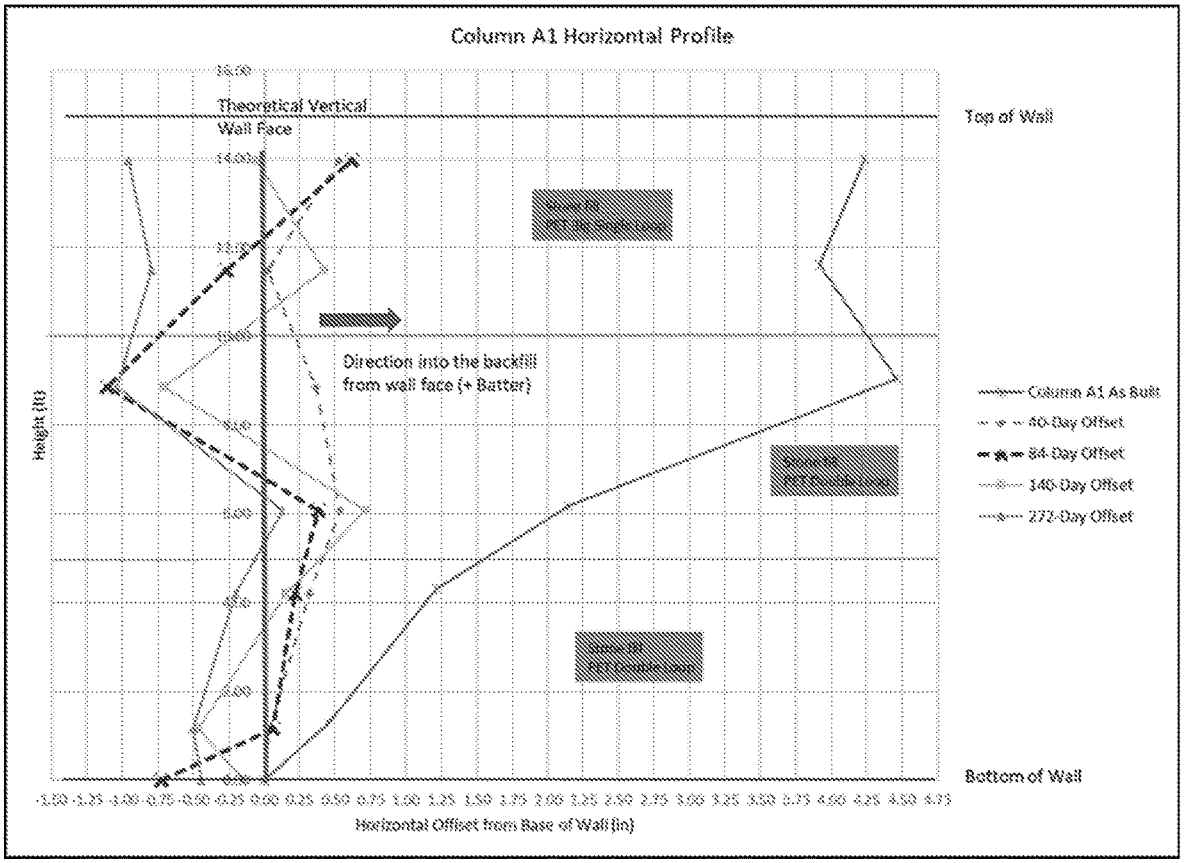
Figure 11:
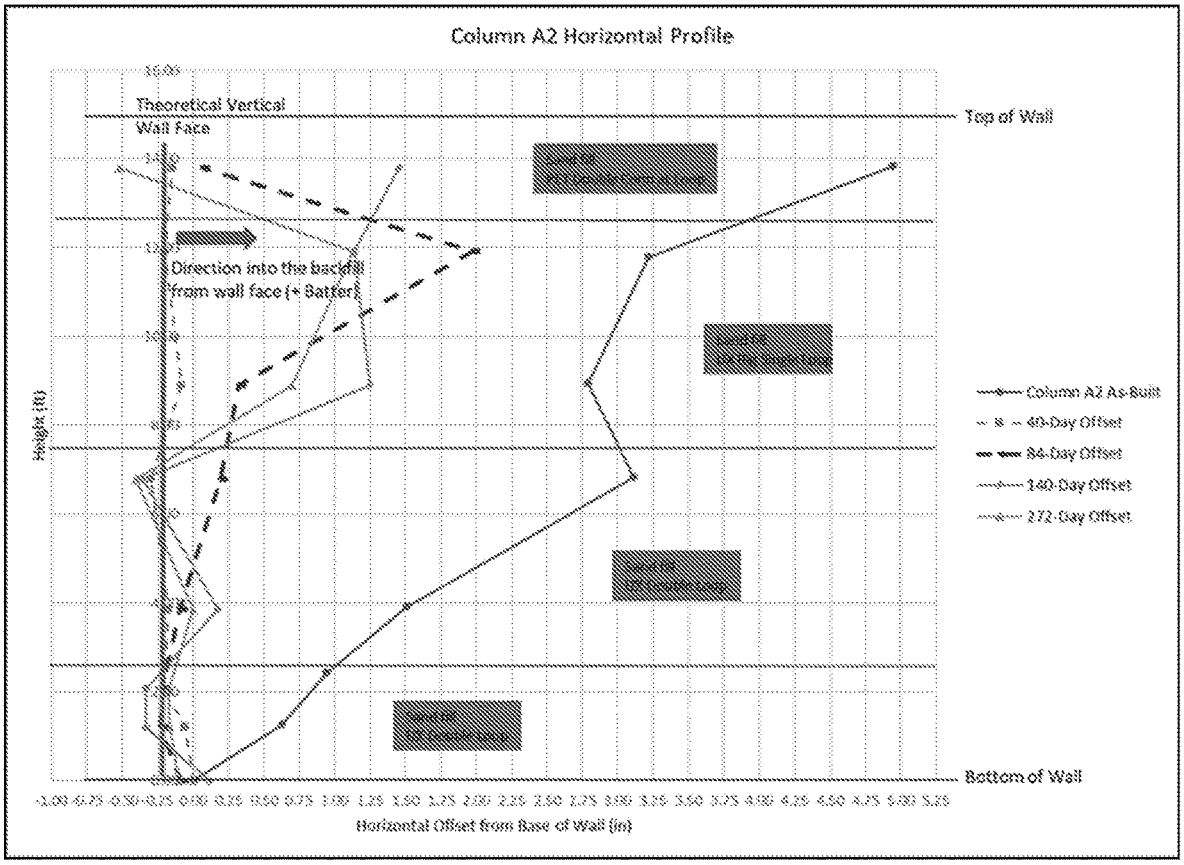
Figure 12:
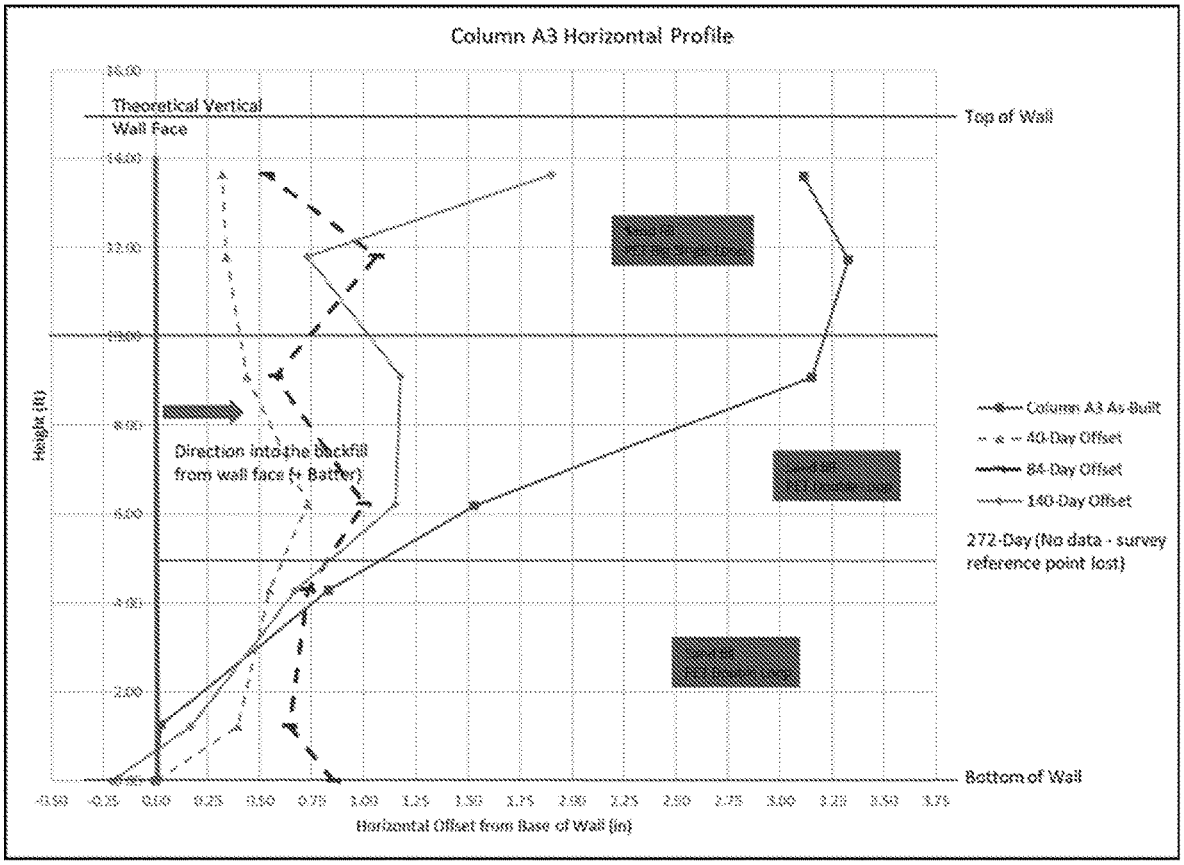
Figure 13:
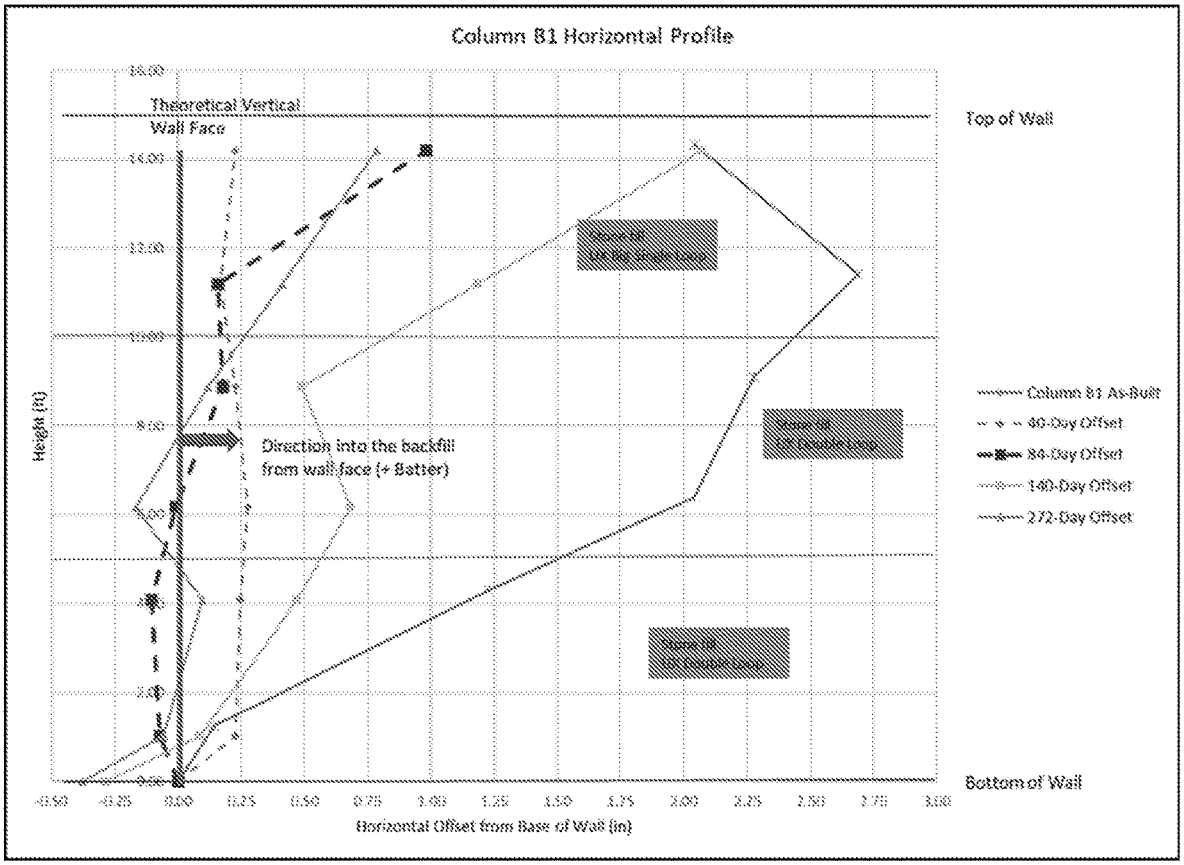
Figure 14:
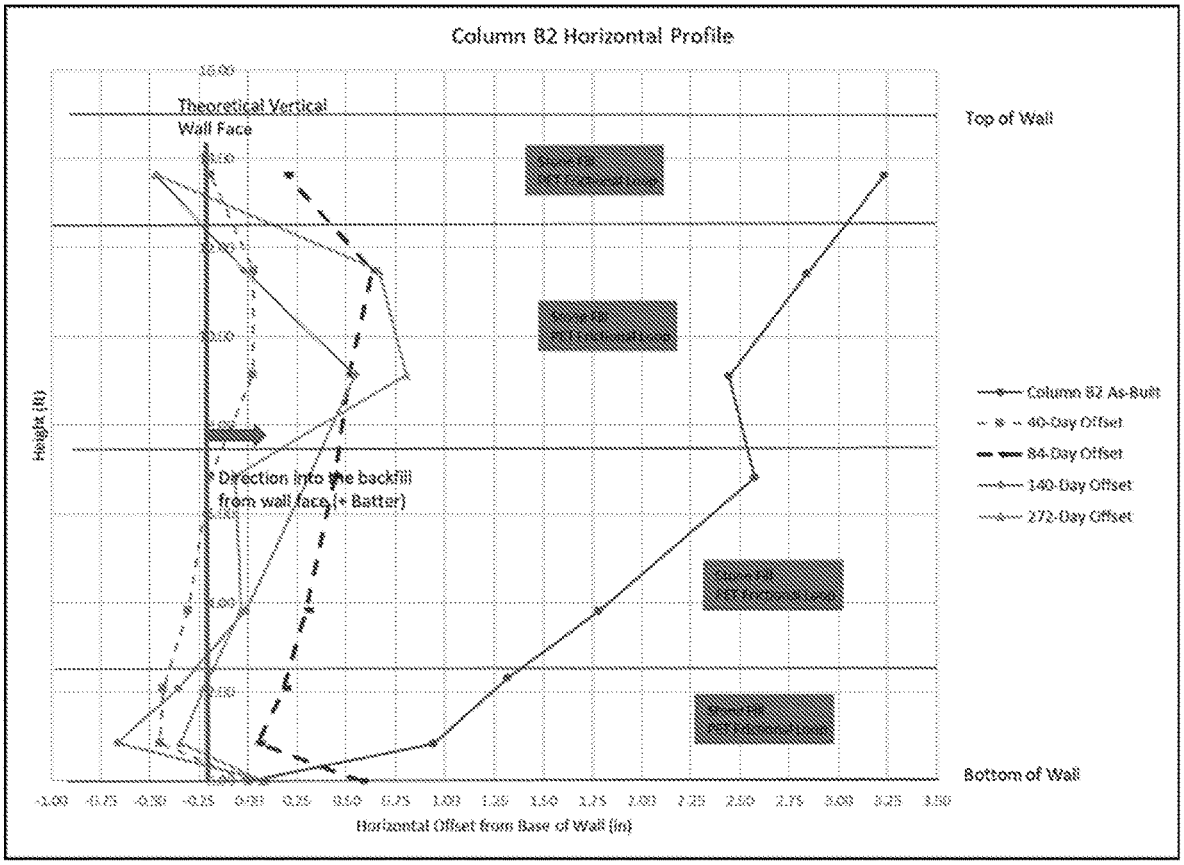
Figure 15:
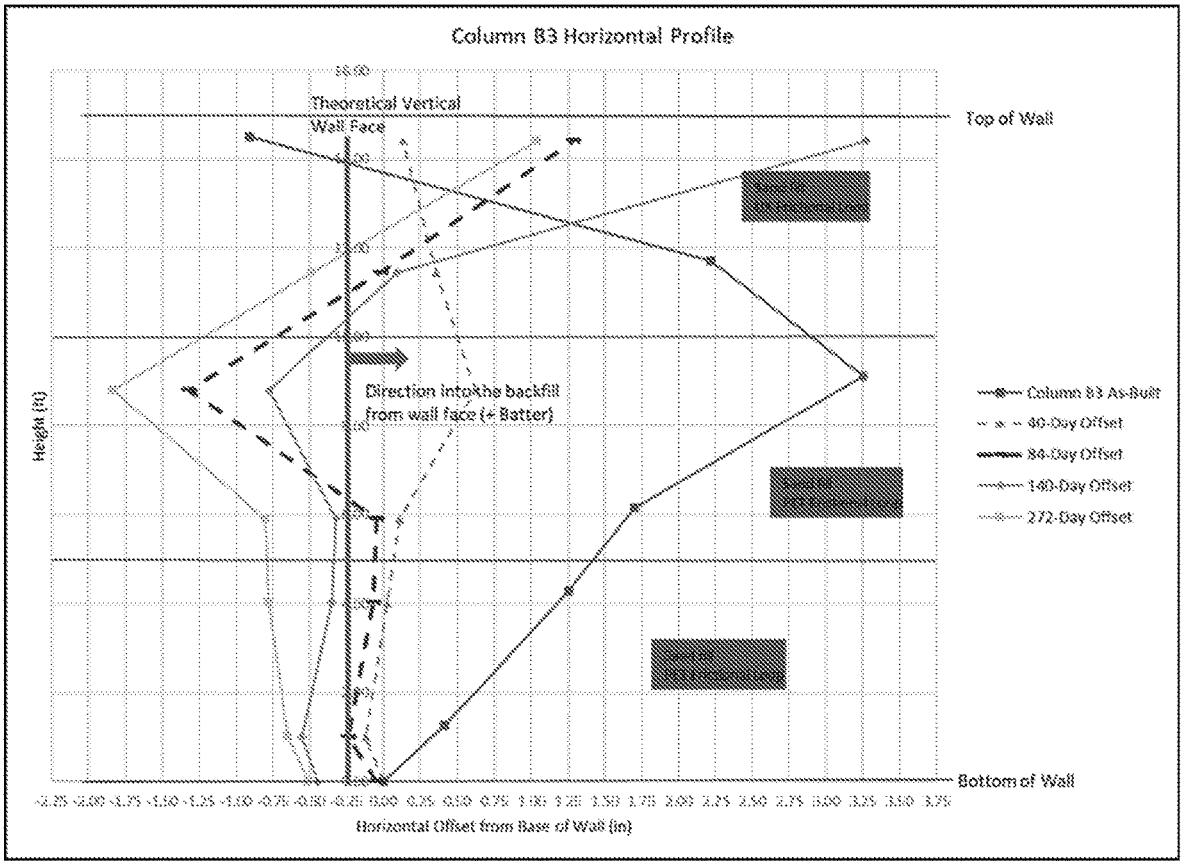

The horizontal wall profiles for each column of the completed walls are shown in FIG. 10 through FIG. 15. Namely, FIG. 10 shows a plot 300 of the Horizontal Wall Profile at Column A-1; FIG. 11 shows a plot 400 of the Horizontal Wall Profile at Column A-2; FIG. 12 shows a plot 500 of the Horizontal Wall Profile at Column A-3; FIG. 13 shows a plot 600 of the Horizontal Wall Profile at Column B-1; FIG. 14 shows a plot 700 of the Horizontal Wall Profile at Column B-2; and FIG. 15 shows a plot 800 of the Horizontal Wall Profile at Column B-3.

Based on the panel alignment data, all panels were plumb or with positive batter except panels with geogrid loop through two stabilizing hoops 102 on a panel (FIG. 10 through FIG. 15) at height between 10 to 15 feet (3.05 to 4.57 meters). The movement of the concrete panels after construction at 40, 84, 140, and 272 days were small and within the margin of error. Also, it was demonstrated that panel stability can be achieved using either sand or stone as hoop infill.

Example 2

In another example of the present subject matter, a large-scale connection test program was carried out to evaluate the effectiveness and quantify the connection strength of the hoop connection system with HDPE and PET soil reinforcing strips (i.e., soil reinforcing elements 104) without a mechanical connector. PET soil reinforcement is high in allowable tensile strength but is not easily connected to wall facing panels. Mechanically connecting PET reinforcing element to the wall facing panels are typically inefficient due to low junction strength or requiring weaving or wrapping of the PET reinforcement through an expensive high strength mechanical connector connected to the wall facing panels. HDPE soil reinforcement typically has high junction strength to form strong connection to wall facing panels but requires a robust mechanical connector.

In an example of a large-scale connection test set up, an 8-inch (20.32-cm) high Tensar® UX1900 geogrid strip was cast 2.5 inches (6.35 cm) into the concrete and 4 inches (10.16 cm) away from the edges of the concrete panel to form an approximately 2 feet (0.61 m) deep hoop. The concrete panel was 16 inches (0.41 m) high×32 inches (0.81 m) wide×5.5 inches (13.97 cm) thick with a 4000-psi minimum concrete compressive strength. The connection tests were performed using No. 57 stone and concrete sand for the hoop infill with HDPE and PET geogrid strips (hereafter called "geostrips") as soil reinforcing elements 104. The tests were performed with 200-psf and 1000-psf overburden pressures to simulate loading conditions close to top and at 9 feet (2.74 m) deep into the wall respectively. The connection strength, displacement, and failure mode test results were recorded and summarized in Table 900 shown in FIG. 16.

The following observations and conclusions were made based on the connection test results and failure mode:

1) The connection system is mechanical with the measured connection strength just slightly higher at high overburden pressure versus at low overburden pressure.
2) The connection strength is robust with the ultimate connection strength greater than the long-term design strength of the geostrip soil reinforcement without a mechanical connector.
3) The connection strength is controlled by the long-term design strength of the primary geostrip reinforcement.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments ±100%, in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A geosynthetic panel wall system, comprising:

a single concrete facing panel;

a plurality of stabilizing hoops, each stabilizing hoop of the plurality having two ends, wherein the plurality of stabilizing hoops are formed bending away from the single concrete facing panel and wherein the two ends of each stabilizing hoop are fully coupled to one side of the single concrete facing panel; and a soil reinforcing element coupled to the stabilizing hoops.

2. The geosynthetic panel wall system of claim 1, wherein concrete facing panel is a wet-cast fabricated concrete facing panel.

3. The geosynthetic panel wall system of claim 1, wherein the geosynthetic panel wall system comprises a plurality of concrete facing panels, wherein each concrete facing panel of the plurality of concrete facing panels is coupled to a plurality of stabilizing hoops fully coupled on one side of each concrete facing panel.

4. The geosynthetic panel wall system of claim 3, wherein the multiple concrete facing panels are arranged end-to-end, and wherein each of the multiple concrete facing panels is coupled to the multiple stabilizing hoops.

5. The geosynthetic panel wall system of claim 1, wherein the plurality of stabilizing hoops are arranged vertically on the concrete facing panel.

6. The geosynthetic panel wall system of claim 1, wherein the plurality of stabilizing hoops is arranged side-by-side on the concrete facing panel.

7. The geosynthetic panel wall system of claim 1, wherein the plurality of stabilizing hoops are semi-circular in shape having a height H, a length L, and a depth D.

8. The geosynthetic panel wall system of claim 7, wherein the height H is from about 6 inches (15.24 cm) to about 30 inches (76.2 cm), and the length L and the depth D are from about 24 inches (60.96 cm) to about 96 inches (243.84 cm).

9. The geosynthetic panel wall system of claim 8, wherein the height H is about 8 inches (20.32 cm) and wherein the length L and depth D are about 36 inches (91.44 cm).

10. The geosynthetic panel wall system of claim 1, wherein at least one of the plurality of stabilizing hoops is made of polymer, steel, or a composite material.

11. The geosynthetic panel wall system of claim 1, wherein at least one of the plurality of stabilizing hoops is filled with soil fill.

12. The geosynthetic panel wall system of claim 1, wherein the soil reinforcing element is a strip having a width.

13. The geosynthetic; panel wall system of claim 12, wherein the width is from about 6 inches (15.24 cm) to about 48 inches (121.92 cm).

14. The geosynthetic panel wall system of claim 13, wherein the width is about is about 24 inches (60.96 cm).

15. The geosynthetic panel wall system of claim 12, wherein the strip is a continuous wrap from the bottom of at least one of the plurality of stabilizing hoops to the top of the at least one of the plurality of stabilizing hoops and adapted to be splayed.

16. The geosynthetic panel wall system of claim 15, wherein the strip is made of PET, HDPE, or other flexible material.

17. The geosynthetic panel wall system of claim 12, wherein the strip is a geogrid made of geotextiles.

18. The geosynthetic panel wall system of claim 1, wherein the concrete facing panel is coupled atop a leveling pad to form a free standing gravity geosynthetic panel wall system.

19. A method of reinforcing a wall, comprising the steps of:

providing a geosynthetic panel wall system having each of a single concrete facing panel, a plurality of stabilizing hoops, each stabilizing hoop of the plurality having two ends, and at least one soil reinforcing element;

casting one or more of the plurality of stabilizing hoops onto the concrete facing panel, wherein the concrete facing panel is coupled to a plurality of stabilizing hoops, wherein the two ends of each stabilizing hoop are fully coupled on one side of the concrete facing panel and wherein the hoops are formed bending away from the one side;

forming a leveling pad;

propping the concrete facing panel atop the leveling pad;

placing and compacting soil backfill against the one side of the concrete facing panel up to the bottom of the coupled stabilizing hoops;

cutting the soil reinforcing element into a strip;

placing the strip through the at least one of the plurality of stabilizing hoops against and over the concrete facing panel;

filling at least one of the plurality of the stabilizing hoops with soil fill;

placing and compacting backfill up to the top of at least one of the plurality of stabilizing hoops; and folding down the strip into the backfill.

20. The method according to claim 19, wherein the geosynthetic panel wall system comprises a plurality of concrete facing panels, wherein each concrete facing panel of the plurality of concrete facing panels is coupled to a plurality of stabilizing hoops fully coupled on one side of each concrete facing panel.

* * * * *